US006302978B1

(12) United States Patent
Takita

(10) Patent No.: US 6,302,978 B1
(45) **Date of Patent: *Oct. 16, 2001**

(54) COATED OXIDIZING AGENT

(75) Inventor: Kenji Takita, Tokyo (JP)

(73) Assignee: Chugai Seiyaku Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 21 days.

(21) Appl. No.: 09/284,364

(22) PCT Filed: Oct. 17, 1997

(86) PCT No.: PCT/JP97/03763

§ 371 Date: Apr. 14, 1999

§ 102(e) Date: Apr. 14, 1999

(87) PCT Pub. No.: WO98/17606

PCT Pub. Date: Apr. 30, 1998

(30) Foreign Application Priority Data

Oct. 22, 1996 (JP) ..... 8-279573

(51) Int. Cl.[7] ..... C06B 45/30; C06B 31/28; C06B 31/02

(52) U.S. Cl. ..... 149/5; 149/46; 149/61

(58) Field of Search ..... 149/3, 46, 61, 149/75, 76, 5, 6

(56) References Cited

U.S. PATENT DOCUMENTS

| | | | | |
|---|---|---|---|---|
| 2,407,151 | | 9/1946 | Glogau | 52/14 |
| 3,046,888 | * | 7/1962 | Gordon | 102/22 |
| 3,453,155 | * | 7/1969 | Sheeran et al. | 149/5 |
| 3,779,821 | * | 12/1973 | Fujiki et al. | 149/7 |
| 3,834,955 | | 9/1974 | Fox et al. | 149/7 |
| 3,862,866 | * | 1/1975 | Timmerman et al. | 149/21 |
| 5,041,177 | * | 8/1991 | Hajto et al. | 149/5 |
| 5,345,873 | * | 9/1994 | Lauritzen et al. | 102/290 |
| 5,682,013 | * | 10/1997 | Smith et al. | 149/6 |

FOREIGN PATENT DOCUMENTS

| | | | |
|---|---|---|---|
| 0919694 | 11/1954 | (DE) . | |
| 0474115 | 3/1992 | (EP) | C06B/35/00 |
| 0665138 | 8/1995 | (EP) | B60R/21/26 |
| 0617285 | 2/1927 | (FR) . | |
| 0735745 | 11/1932 | (FR) . | |
| 50-040487 | 4/1975 | (JP) | A62B/35/00 |
| 63-185908 | 8/1988 | (JP) | A01N/53/00 |
| 6107108 | 4/1994 | (JP) | B60R/21/26 |
| 753302 | 2/1995 | (JP) | A01N/25/20 |

* cited by examiner

*Primary Examiner*—Charles T. Jordan
*Assistant Examiner*—Aileen J. Baker

(57) ABSTRACT

An oxidizer coated with inorganic particles is provided. A method for reducing the mechanical energy sensitivity of an oxidizer is also provided, which comprises coating the oxidizer with inorganic particles. Further, a combustible composition comprising the oxidizer coated with inorganic particles and a fuel as well as a gas generator comprising the oxidizer coated with inorganic particles and a fuel is provided.

14 Claims, 3 Drawing Sheets

COATED OXIDIZING AGENT

TECHNICAL FIELD

The present invention relates to a coated oxidizer and a fuel composition. Specifically, the present invention relates to an oxidizer coated with inorganic particles, and a fuel composition comprising the coated oxidizer and a fuel. The present invention also relates to a method for reducing the mechanical energy sensitivity of an oxidizer, which comprises coating the oxidizer with inorganic particles.

BACKGROUND ART

Combustible oxidizers are usually used as exothermic materials in smoking agents. The combustible oxidizers may also be used in pyrotechnics or as gas generators for automotive air bags.

As a conventional combustible oxidizer, potassium chlorate, potassium nitrate and the like have been mainly used. However, these combustible oxidizers are often highly sensitive to mechanical energy, i.e., energy generated by friction or shock. In particular, potassium chlorate has a high risk of exploding when handled, and hence, Japan Explosive Industry Association regulates its use.

Up to now, there has been no effective method developed for reducing the mechanical energy sensitivity of these combustible oxidizers. When such combustible oxidizers were used, there was no alternative but to handle them carefully.

Exothermic materials used in smoking agents have a risk of detonative reaction during their preparation or transport, since a combustible oxidizer and a fuel are mixed therein and are directly in contact with each other, which then can be easily ignited by mechanical energy such as friction or shock.

On the other hand, gas generators composed mainly of sodium azide are used in automotive air bags. However, with these, there are problems of the disposal of wastes containing sodium residue and the generation of toxic gas. Various efforts have been made to solve these problems; for example, a combination of tetrazoles with an oxidizer or a combination of azodicarbonamide (ADCA) with an oxidizer has been extensively studied as alternative materials to sodium azide.

Japanese patent laid-open publication Hei 3-242392 (1991) teaches a method for desensitizing an oxidizer highly sensitive to friction by forming a matrix with a polymer such as poly glycols. However, most of potential polymers for this invention have softening points of 100° C. or less, and thus they are difficult to handle at an elevated temperature since their lower softening points lead to blocking in a dryer when oxidizers in a matrix are dried. Such polymer-matrix oxidizers have another problem in that they are less ignitable. This is because oxidizers dispersed in the polymer matrix cannot come in direct contact with fuel.

It is also kmown that some oxidizers such as potassium chlorate are unstable under acidic conditions, but no action has been taken to improve the stability of these oxidizers.

An object of the present invention is to provide an oxidizer less sensitive to mechanical energy and a method for reducing its mechanical energy sensitivity in order to make the handling easy and safe.

Another object of the present invention is to solve the problems of the above conventional oxidizers such as poor stability to heat or acids, and to solve the problems of the above conventional polymer-matrix oxidizers such as difficulties of handling them at an elevated temperature as well as poor ignitability.

A further object of the present invention is to provide a combustible composition having a low risk of, for example, detonative reaction.

A still further object of the present invention is to provide a gas generator for use in an air bag having a proper maximum pressure. Such air bag can then be produced at low cost.

DISCLOSURE OF THE INVENTION

We have made every effort to reduce the mechanical energy sensitivity of an oxidizer while improving its handling at an elevated temperature, its stability to heat or acids and its ignitability. As a result, we have found that an oxidizer with desired properties could be attained by coating the oxidizer with inorganic particles. Thus, the present invention has been achieved.

Accordingly, the present invention provides an oxidizer coated with inorganic particles. The present invention also provides a method for reducing the mechanical energy sensitivity of an oxidizer, which comprises coating the oxidizer with inorganic particles. The present invention further provides a combustible composition comprising the oxidizer coated with inorganic particles and a fuel. The present invention further provides a gas generator comprising the oxidizer coated with inorganic particles and a fuel.

The coated oxidizer of the present invention is less sensitive to mechanical energy as a result of coating with inorganic particles. In the present invention, it is advantageous to use oxidizers highly sensitive to mechanical energy, i.e., those which may cause a rapid and accelerated oxidation such as an explosive reaction initiated by a slight energy generated by friction or shock. For example, the oxidizers highly sensitive to mechanical energy may have a ⅙ explosion point of 21.6 kgf or less, preferably 19.2 kgf or less, more preferably 16.0 kgf or less, as measured in BAM friction sensitivity test. Such oxidizers include, but are not limited to, potassium chlorate, potassium bromate, potassium iodate, potassium perchlorate, sodium chlorate, ammonium nitrate and potassium nitrate. The oxidizers may be used alone or in combination. The oxidizer may have a particle diameter, for example, between 0.01 and 5 mm, preferably between 0.1 and 3 mm.

Inorganic materials used in the present invention may be inactive. The term "inactive" used here means non-reactive with the oxidizer to be coated. Such inorganic materials include, but are not limited to, talc, calcium silicate, clay, bentonite and carprex, out of which, talc and calcium silicate are preferred. The inorganic materials may be used alone or in combination. Particles of the inorganic materials may have a particle diameter, for example, between 0.5 and 50 $\mu$m, preferably between 2 and 20 $\mu$m.

The coated oxidizers of the present invention can be used as combustible oxidizers such as exothermic materials for smoking agents, oxidizers for pyrotechnics, and oxidizer components of gas generators for automotive air bags.

An air bag having a proper maximum pressure can be produced at low cost when the technique of the present invention is applied to the preparation of a gas generator for the air bag.

The present invention also encompasses a combustible composition comprising the oxidizer coated with inorganic particles and a fuel.

BEST MODES FOR CARRYING OUT THE INVENTION

Figure 1:
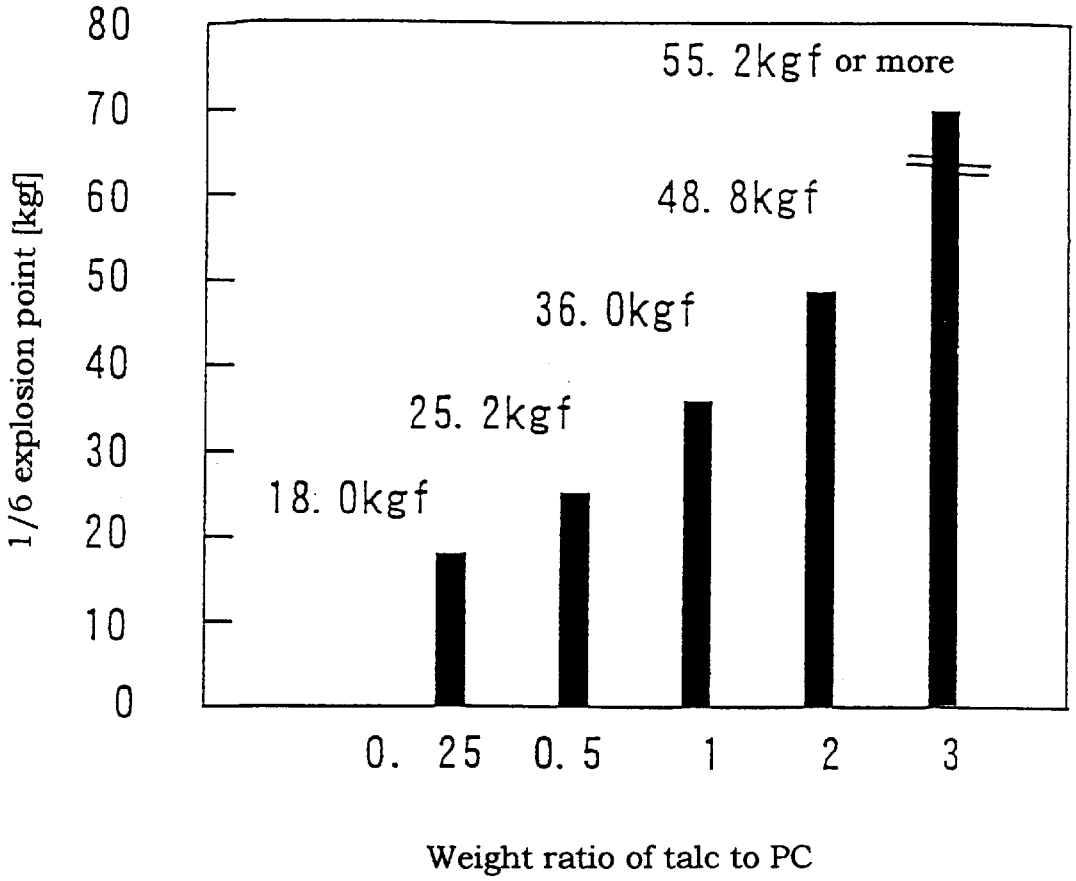
FIG. 1 shows results of the friction sensitivity test using oxidizers coated with talc.

The coated oxidizer of the present invention may be prepared, for example, by a wet method as follows:

Powders of oxidizer such as potassium chlorate (about 0.01 to 5 mm, preferably about 0.1 to 3 mm in diameter) may be mixed with a binder and an inorganic material such as talc or calcium silicate, which is in the form of fine particles of about 0.5 to 50 $\mu$m, preferably about 2 to 20 $\mu$m in diameter.

The binder used in the present invention includes, but is not limited to, hydroxypropyl methylcellulose, hydroxymethyl cellulose, methyl cellulose, ethyl cellulose, sodium alginate, polyvinyl alcohol and dextrin, out of which, hydroxypropyl methyl cellulose and hydroxymethyl cellulose are preferred.

The weight ratio of oxidizer to inorganic material may be 1:0.01 to 1:5, preferably 1:1 to 1:3. The weight ratio of oxidizer to binder may be 1:0.01 to 1:0.1, preferably 1:0.02 to 1:0.06.

The oxidizer, inorganic material and binder may be mixed together and then kneaded with an appropriate amount of aqueous solvent such as water in a mortar using a pestle for about 5 to 30 minutes, preferably 10 to 20 minutes.

The resulting mixture may be dried to obtain the coated oxidizer of the present invention.

Alternatively, the coated oxidizer of the present invention may be prepared, for example, by a dry method as follows:

Agate balls in different sizes are put into an agate mortar, and then the oxidizer and inorganic material, at the ratio as described above, may be mixed in the mortar by a planetary rotary pot mill for 10 minutes to 6 hours, preferably 2 to 4 hours, at a rotary speed of 100 to 200 rpm to obtain the coated oxidizer of the present invention.

For example, even if the coated oxidizer of the present invention is mixed with a fuel to be used in smoking agents, pyrotechnics and gas generators for automotive air bags, it does not come in direct contact with the fuel since it is coated with inorganic particles. A combination of the coated oxidizer of the present invention with a fuel can, therefore, provide a combustible composition with a low risk of detonative reaction by mechanical energy such as friction.

The type of fuel to be mixed with the coated oxidizer of the present invention may be selected depending on the use. For example, when used for smoking agents, saccharides such as glucose, saccharose, fructose, cellulose and starch and wood meal may be used, out of which, saccharides such as glucose, saccharose, fructose, cellulose and starch are preferably used. For pyrotechnics, wood meal, sulfur, glutinous-rice starch, lime pitch, aluminum, magnesium and antimony trisulfide may be used. For use in air bags, anthracene or saccharides such as glucose, saccharose, fructose, cellulose and starch may be used. In addition, petroleum such as heavy oil and light oil, vegetable oil such as rapeseed oil, graphite, iron silicate and gallic acid may be also used as a fuel in the present invention. Further, when the combustible composition of the present invention is used in air bags, a gas generator such as ADCA and tetrazoles may be added to the composition. In this case, the rate of pressure increase can be raised more than when a gas generator such as ADCA or tetrazoles is used alone.

The combustible composition of the present invention may be easily tabletted, molded, wet-molded, encapsulated and granulated, such that it may be industrially handled with ease and safety.

The present invention will be further illustrated by the following examples, which should not be construed to limit the scope of the present invention.

EXAMPLE 1

Preparation of Coated Oxidizers (Wet Method)

The following materials were used: potassium chlorate (PC) of guaranteed reagent grade (Junsei Kagaku; 0.005 to 1 mm in diameter) as an oxidizer, talc in accordance with Japanese Pharmacopoeia (Kanto Kagaku; 2 to 5 $\mu$m in diameter) as inorganic particles, hydroxypropyl methylcellulose ("Metrose 60-SH50"; Shin-etsu Chemical Corp.) as a binder.

Ten grams of PC were mixed with talc at various PC/talc weight ratios of 1:0.25, 1:0.5, 1:1, 1:2 and 1:3. Each mixture was then mixed with 0.5 g of hydroxypropyl methylcellulose at a PC/binder weight ratio of 1:0.05.

Each of the mixtures thus obtained was then kneaded with 2 ml of water in a mortar for about 15 minutes and dried at 60° C. for about 3 hours to obtain various coated oxidizers.

EXAMPLE 2

Preparation of Combustible Compositions (Wet Method)

Each of the coated oxidizers obtained in Example 1 was mixed with glucose as a fuel at a PC/fuel weight ratio (stoichiometric ratio) of 1:0.36 to obtain various combustible compositions.

EXAMPLE 3

Preparation of Coated Oxidizers (Wet Method)

The following materials were used: PC as an oxidizer, calcium silicate ("Flowlight"; Tokuyama Corp.) as inorganic particles, hydroxypropyl methylcellulose as a binder.

Ten grams of PC were mixed with calcium silicate at various PC/calcium silicate weight ratios of 1:0.5, 1:1 and 1:2. Each mixture was then mixed with 0.5 g of hydroxypropyl methylcellulose at a PC/binder weight ratio of 1:0.05.

The same procedure as described in Example 1 was repeated to obtain various coated oxidizers.

EXAMPLE 4

Preparation of Combustible Compositions (Wet Method)

Each of the coated oxidizers obtained in Example 3 was mixed with glucose as a fuel at a PC/fuel weight ratio (stoichiometric ratio) of 1:0.36 to obtain various combustible compositions.

EXAMPLE 5

Preparation of a Coated Oxidizer (Dry Method)

PC and talc were used as an oxidizer and inorganic particles, respectively.

Agate balls in different sizes (3 to 20 mm in diameter) are put into an agate mortar. Fifty grams of PC and 100 g of talc, at a PC/talc weight ratio of 1:2, were mixed in the mortar by a planetary rotary pot mill (ITO Seisakusho) for 3 hours to obtain a coated oxidizer.

EXAMPLE 6

Preparation of a Combustible Composition (Dry Method)

The coated oxidizer obtained in Example 5 was mixed with glucose as a fuel at a PC/fuel weight ratio (stoichiometric ratio) of 1:0.36 to obtain a combustible composition.

EXAMPLE 7

Preparation of Gas Generators (Dry Method)

PC that had been coated with talc by the same procedure as described in Example 5 was mixed with ADCA or glucose as a fuel to obtain gas generators. The ratios of PC, talc and fuel (ADCA or glucose) in the mixtures are shown in Table 1 below.

TEST EXAMPLE 1

Friction Sensitivity Test Using Oxidizers Coated With Talc

Each of the combustible compositions obtained in Example 2 was tested for friction sensitivity. Their ⅙ explosion points were determined using BAM friction sensitivity tester (Kuramochi Science Corp.) by loading two weights up to 55.2 kgf. Test results are shown in FIG. 1. A ⅙ explosion point of an uncoated oxidizer was 4.8 kgf (PC/glucose weight ratio=1/0.36).

It is revealed that the friction sensitivity is reduced significantly as the talc content is increased. The friction sensitivity was reduced beyond the limit of measurement at a PC/talc weight ratio of 1:3.

TEST EXAMPLE 2

Friction Sensitivity Test Using Oxidizers Coated With Calcium Silicate

Figure 2:
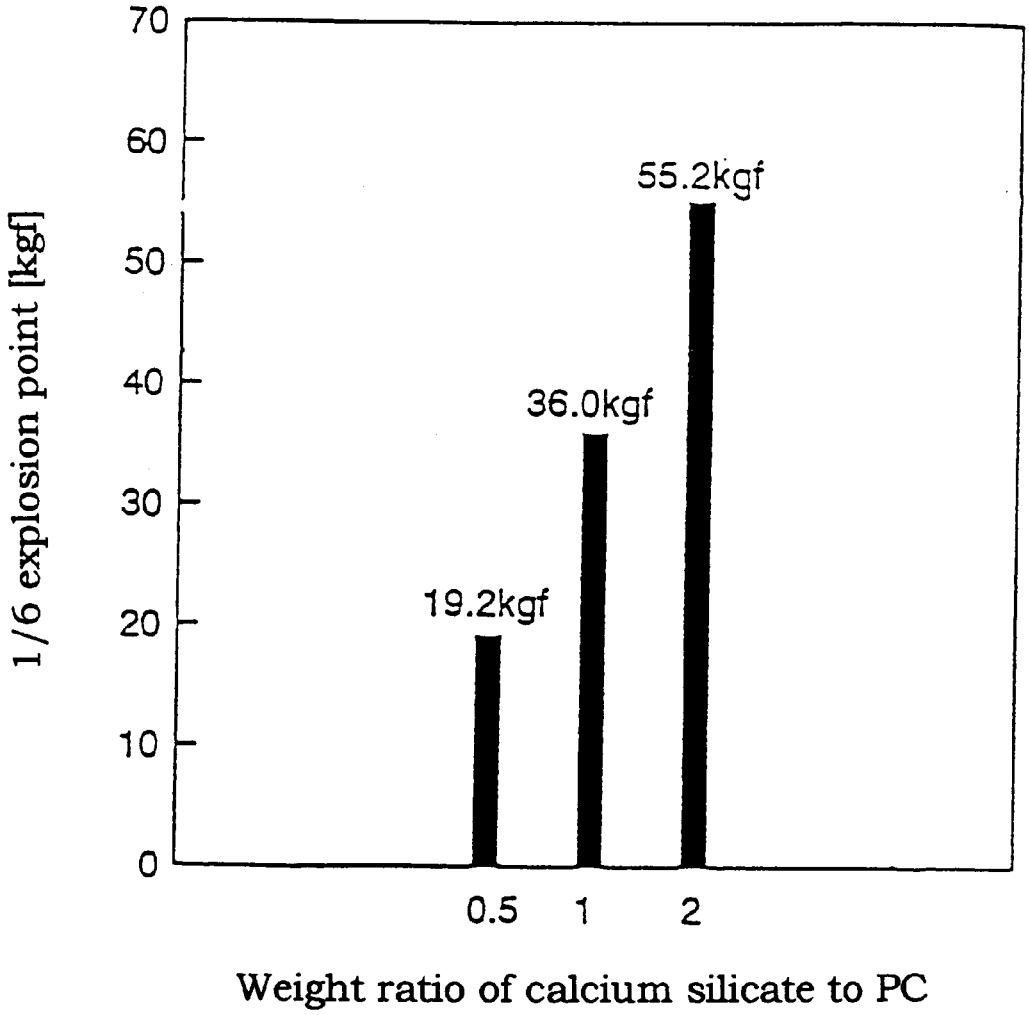
FIG. 2 shows results of the friction sensitivity test using oxidizers coated with calcium silicate.

Each of the combustible compositions obtained in Example 4 was tested for friction sensitivity. Their ⅙ explosion points were determined using BAM friction sensitivity tester (Kuramochi Science Corp.) by loading two weights up to 55.2 kgf. Test results are shown in FIG. 2. A ⅙ explosion point of an uncoated oxidizer was 4.8 kgf (PC/glucose weight ratio=1/0.36).

It is revealed that the friction sensitivity is reduced significantly as the calcium silicate content is increased. The friction sensitivity was reduced beyond the limit of measurement at a PC/calcium silicate weight ratio of 1:2.

TEST EXAMPLE 3

Impact Sensitivity Test

Of the combustible compositions obtained in Example 2, the one at a PC/talc weight ratio of 1:2 was subjected to impact sensitivity test, a kind of test for determining the mechanical energy sensitivity. The test was carried out by using JIS impact sensitivity tester (Kuramochi Science Corp.). It is revealed that no explosion was caused by repeating the test six times from a height of 100 cm.

TEST EXAMPLE 4

Thermal Stability Test

The combustible compositions obtained in Examples 2 and 6 were tested for thermal stability under acidic conditions. Of the combustible compositions obtained in Example 2, the one at a PC/talc weight ratio of 1:2 was subjected to the test. Formic acid as an acidic material was added to these two combustible compositions and heat generation was detected by calorimeter (C80D). As a control, a combustible composition containing an uncoated oxidizer and glucose as a fuel was tested (PC/glucose weight ratio=1/0.36).

When formic acid was added to each of the combustible compositions at a concentration of 5%, no heat generation was detected in the compositions of the present invention during isothermal test at 100° C., whereas heat generation was detected in the control. It is therefore revealed that the combustible compositions of the present invention are excellent in thermal stability.

TEST EXAMPLE 5

Ignitability Test

Figure 3:
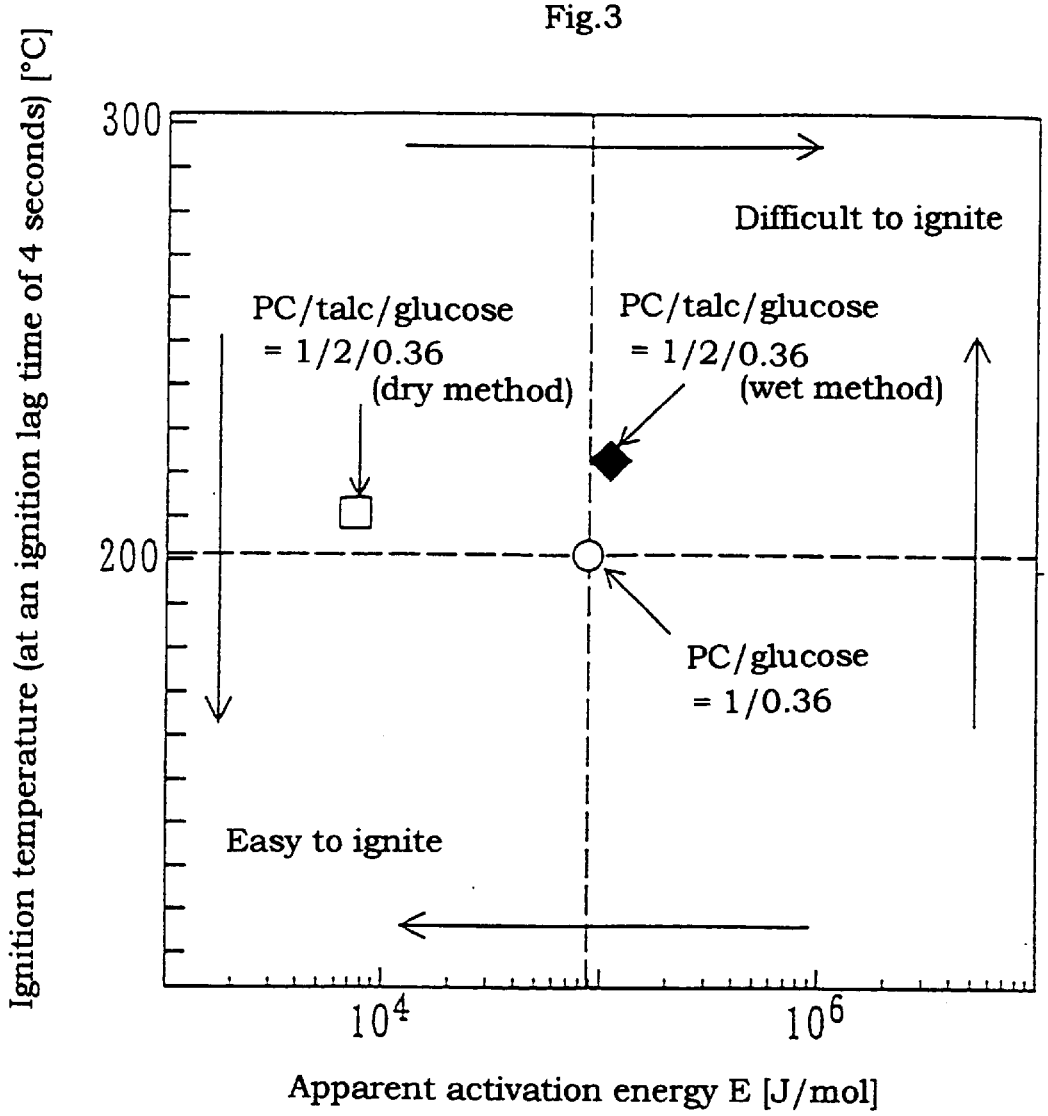
FIG. 3 shows results of the ignitability test.

The combustible compositions of the present invention were tested for ignitability by using Krupp ignition temperature tester (Kuramochi Science Corp.). As a combustible composition prepared by a wet method, the one obtained in Example 2 at a PC/talc weight ratio of 1:2 was used, and as a combustible composition prepared by a dry method, the one obtained in Example 6 was used. As a control, a combustible composition containing an uncoated oxidizer and glucose as a fuel was tested (PC/glucose weight ratio=1/0.36). Test results are shown in FIG. 3.

Although the data on apparent activation energy suggest that the combustible composition prepared by the wet method is slightly less ignitable than the control, there is no problem foreseen in actual practice. It is also suggested that although the combustible composition prepared by the dry method has a higher ignition point than that of the control by about 10° C., its activation energy is lower, and hence, it is as ignitable as the control.

TEST EXAMPLE 6

MkIIId Ballistic Mortar Test

Of the combustible compositions obtained in Example 2, the one at a PC/talc weight ratio of 1:2 was tested for static explosion strength by using MkIIId ballistic mortar tester (RARDE Corp.) in order to examine its safety during disasters such as fire. As a control, a combustible composition containing an uncoated oxidizer and glucose as a fuel was tested (PC/glucose weight ratio=1/0.36). Both of the samples contained 2 g of PC as an active ingredient. The experiment was evaluated by comparing a swing of the mortar for each sample to a swing of the mortar for trinitrotoluene (TNT) (a swing for TNT was set to 1). It is revealed that the combustible composition of the present invention has the explosion strength reduced to about one-sixth when compared with the control.

TEST EXAMPLE 7

Test for Maximum Pressure

Each sample (10 g) of gas generators were ignited via nichrome wire (0.25 mm in diameter; 10 V-2.5 A) in a closed steel cylinder (one-litter volume; custom-made). Their maximum pressures were detected by a strain pressure gauge capable of detecting up to 100 kg/cm$^2$, which had been placed at the head of the cylinder, and measured using an oscilloscope (TDS-520A, Sony Techtronics). Test results are shown in Table 1.

TABLE 1

Composition and maximum pressure of the gas generators.

| Sample | Maximum Pressure (kg/cm$^2$) |
|---|---|
| PC/Talc/ADCA | |
| 1/0.5/0.17 | 11 |
| 1/0.5/0.7 | 18 |
| 1/0.5/3.5 | 8 |
| 1/1/0.7 | 15 |
| 2/1/0.7 | 6 |
| PC/Talc/Glucose | |
| 1/0.5/0.7 | 16 |
| 1/0.5/1.5 | 16 |
| 1/1/0.7 | 12 |
| 2/1/3.0 | 10 |

INDUSTRIAL APPLICABILITY

According to the present invention, the mechanical energy sensitivity of an oxidizer can be reduced by coating the oxidizer with inorganic particles, and thus oxidizers highly sensitive to mechanical energy can be industrially handled with more ease and safety. Accordingly, oxidizers such as potassium chlorate, which have been difficult to utilize for industrial applications including air bags and smoking agents, can be easily utilized.

Further, in the combustible composition obtained by mixing the coated oxidizer of the present invention with a fuel, the oxidizer is not in direct contact with the fuel since it is coated with inorganic particles. Accordingly, the combustible composition of the present invention has a low risk of detonative reaction caused by mechanical energy such as friction or shock during its preparation or transport.

Furthermore, the use of a gas generator containing the coated oxidizer of the present invention and a fuel contributes to the low cost production of an air bag having a proper maximum pressure.

What is claimed is:

1. An oxidizer coated with a coating comprising inorganic particles, wherein the coating reduces the mechanical energy sensitivity of the oxidizer, said oxidizer and said inorganic particles being present in a weight ratio of about 1:0.25 to about 1:3.

2. The oxidizer of claim 1, wherein the inorganic particles are inert.

3. The oxidizer of claim 1, wherein the inorganic particles are selected from the group consisting of talc, calcium silicate and combinations thereof.

4. The oxidizer of claim 1, wherein the inorganic particles have a particle diameter between 0.5 and 50 $\mu$m.

5. The oxidizer of claim 1, wherein the oxidizer before being coated with the inorganic particles has a ⅙ explosion point of 21.6 kgf or less as measured in BAM friction sensitivity test.

6. The oxidizer of claim 5, wherein the oxidizer is selected from the group consisting of potassium chlorate, potassium bromate, potassium iodate, potassium perchlorate, sodium chlorate, ammonium nitrate, potassium nitrate and combinations thereof.

7. The oxidizer of claim 1, which is used as a combustible oxidizer.

8. A method for reducing the mechanical energy sensitivity of an oxidizer, which comprises coating the oxidizer with inorganic particles, said oxidizer and said inorganic particles being present in a weight ratio of about 1:0.25 to about 1:3.

9. A combustible composition, which comprises the oxidizer of claim 1 and a fuel.

10. A gas generator, which comprises the oxidizer of claim 1 and a fuel.

11. The gas generator of claim 10, wherein the fuel is saccharides.

12. A gas generator for air bags, which comprises the combustible composition of claim 9.

13. An air bag, which comprises the gas generator of claim 10.

14. An oxidizer coated with a coating comprising inorganic particles, said oxidizer being coated with said coating by a method comprising the steps of:

1) mixing an oxidizer with inorganic particles, said oxidizer and inorganic particles being present in a weight ratio of about 1:0.25 to about 1:3, and 2) rotating the resulting mixture together with balls of different sizes to obtain the coated oxidizer.

* * * * *